US012276095B1

(12) United States Patent
Burris

(10) Patent No.: US 12,276,095 B1
(45) Date of Patent: Apr. 15, 2025

(54) STANDALONE ADJUSTABLE SHOWERHEAD SUPPORT SYSTEM

(71) Applicant: RHM INNOVATIONS INC., Rochester, NY (US)

(72) Inventor: Courtney J. Burris, Buffalo, NY (US)

(73) Assignee: RHM Innovations Inc., Buffalo, NY (US)

( * ) Notice: Subject to any disclaimer, the term of this patent is extended or adjusted under 35 U.S.C. 154(b) by 0 days.

(21) Appl. No.: 18/484,770

(22) Filed: Oct. 11, 2023

(51) Int. Cl.
*E03C 1/00* (2006.01)
*E03C 1/06* (2006.01)

(52) U.S. Cl.
CPC ..... *E03C 1/066* (2013.01)

(58) Field of Classification Search
None
See application file for complete search history.

(56) References Cited

U.S. PATENT DOCUMENTS

| | | | | |
|---|---|---|---|---|
| 12,071,753 | B2 * | 8/2024 | Burris | A47K 3/282 |
| 2007/0295866 | A1 * | 12/2007 | Yang | E03C 1/066 248/70 |
| 2020/0018051 | A1 * | 1/2020 | Wilson | E03C 1/0408 |
| 2023/0144622 | A1 * | 5/2023 | Burris | A47K 3/288 4/605 |
| 2023/0383509 | A1 * | 11/2023 | Wilson | E03C 1/025 |
| 2024/0159034 | A1 * | 5/2024 | Xie | E03C 1/066 |

* cited by examiner

*Primary Examiner* — Steven M Marsh
(74) *Attorney, Agent, or Firm* — Stadler IP Law PLLC

(57) ABSTRACT

A standalone adjustable showerhead support system for use in a shower where the user may require an assistant and/or a chair while showering. The showerhead support system includes a showerhead support assembly having a showered hose support, a showerhead support track, a showerhead support connector assembly, a showerhead support leg, and a showerhead support base. The standalone adjustable showerhead support system has three degrees of freedom as the showerhead can be moved front to back, up and down, and side to side. In this way, the showerhead support system can provide shower spray to most areas of the body.

15 Claims, 9 Drawing Sheets

STANDALONE ADJUSTABLE SHOWERHEAD SUPPORT SYSTEM

FIELD OF INVENTION

This invention is directed to a showerhead support system, in particular, to a standalone adjustable showerhead support system.

BACKGROUND OF INVENTION

A bath is one of life's simplest pleasures and a critical component of personal hygiene. Yet for some populations (e.g., the elderly or chronically ill) this is a major challenge. The purpose of a daily bath is not just cleanliness, but it also improves a person's self-image, emotional, and mental well-being, which has a direct impact on their physical well-being. Experts say that for the aging population, "losing the ability to bathe is associated with having falls, fracturing bones, and even being admitted to a nursing home." In fact, nearly a quarter million people are injured in the bathroom each year, and 70% of them are injured while bathing.

Elderly individuals have difficulty with movement, specifically being able to stand for long periods of time and raise their arms over their head. This causes issues while bathing and makes it difficult for the elderly to wash their hair and back.

Similarly, temporarily limited people (those with broken bones, pregnant women, people recovering from surgery, etc.) are unable to stand in the shower or have limited range of motion due to their 'ailment'.

For the above people, it is difficult to hold a showerhead for the duration of a shower due to weakened muscles. Showering can be messy if the flow of water is not properly contained, this is especially difficult when using a removable showerhead because there is no way to stabilize it. Moreover, some facilities don't allow people who would be otherwise independent to bathe themselves for fear of accidental strangulation with the shower hose.

To address these issues, there are currently two options on the market, (1) assisted or self-sponge bathing and (2) a stationary clip which holds the showerhead to the leg of a shower chair. Considering five categories for comparison: independence, flexibility, comfort, containment, and time saving, both current solutions are inadequate.

Sponge bathing does not offer independence, especially if it's assisted, then the person has no control over what is happening and if they do it themselves, it would be infeasible to reach their entire body. Similarly, this option does not offer flexibility as the person can only reach as much as their range of motion allows. In terms of comfort, during a sponge bath a person is exposed to the air whilst being washed, which leads to a very cold and uncomfortable experience. Additionally, sponge baths are often done in places outside of a shower, such as in a bed, which can be very messy because the water is not contained (i.e., poor containment). Lastly, bathing another person can be a time-consuming task and may require multiple people, depending upon how resistant a person is to being bathed.

A stationary clip does not enable full independence while bathing because the person is only able to reach the parts of their body which they can reach without assistance, which also means it lacks flexibility. Due to the limitations users may be facing, often times trying to wash their body, especially their back and hair, is uncomfortable and potentially painful. This also makes it difficult for the user to control the flow of water as there is nothing to stabilize the showerhead during the bathing process, which can lead to a mess. Thus, this solution does not provide containment. Lastly, the user will more than likely require assistance when using this, to get fully clean, which requires the time of multiple people.

Thus, it would be desirable to provide people with physical limitations a standalone adjustable showerhead that allows them the ability to bathe or take a shower independently.

SUMMARY OF THE INVENTION

Accordingly, it is the subject of this invention to provide a standalone adjustable showerhead support system that moves a removable showerhead along a track, laterally, up/down and forwards/backwards, enabling independence and promoting comfort while bathing.

DETAILED DESCRIPTION OF THE INVENTION

List of Components

Showerhead support system—10
Showerhead support assembly—100
Showerhead hose support—110
Showerhead hose—115
Showerhead support track—120
Showerhead support connector assembly—125
Connector—130
Adjuster—135
Extender—140
Showerhead handle support—145
Fastener—150
Showerhead—155
Showerhead handle—160
Showerhead support pivot—170
Bolt or screw—175
Showerhead support leg assembly—200
Showerhead support leg—210
First height adjustment bracket—220
Second height adjustment bracket—230
Showerhead support base—300
Wheels—310
Wheel lock—315

Knob—320
Recess—330
Raised portion or washer—340
Support guide—350
Support guide knob—360

In one embodiment, the showerhead support system 10 helps facilitate showers for users that require an assistant and/or a chair while showering. Showerhead support system 10 functions as a standalone system, thereby allowing the showerhead support system 10 to be moved from place to place and to be used in different showers.

Figure 1:
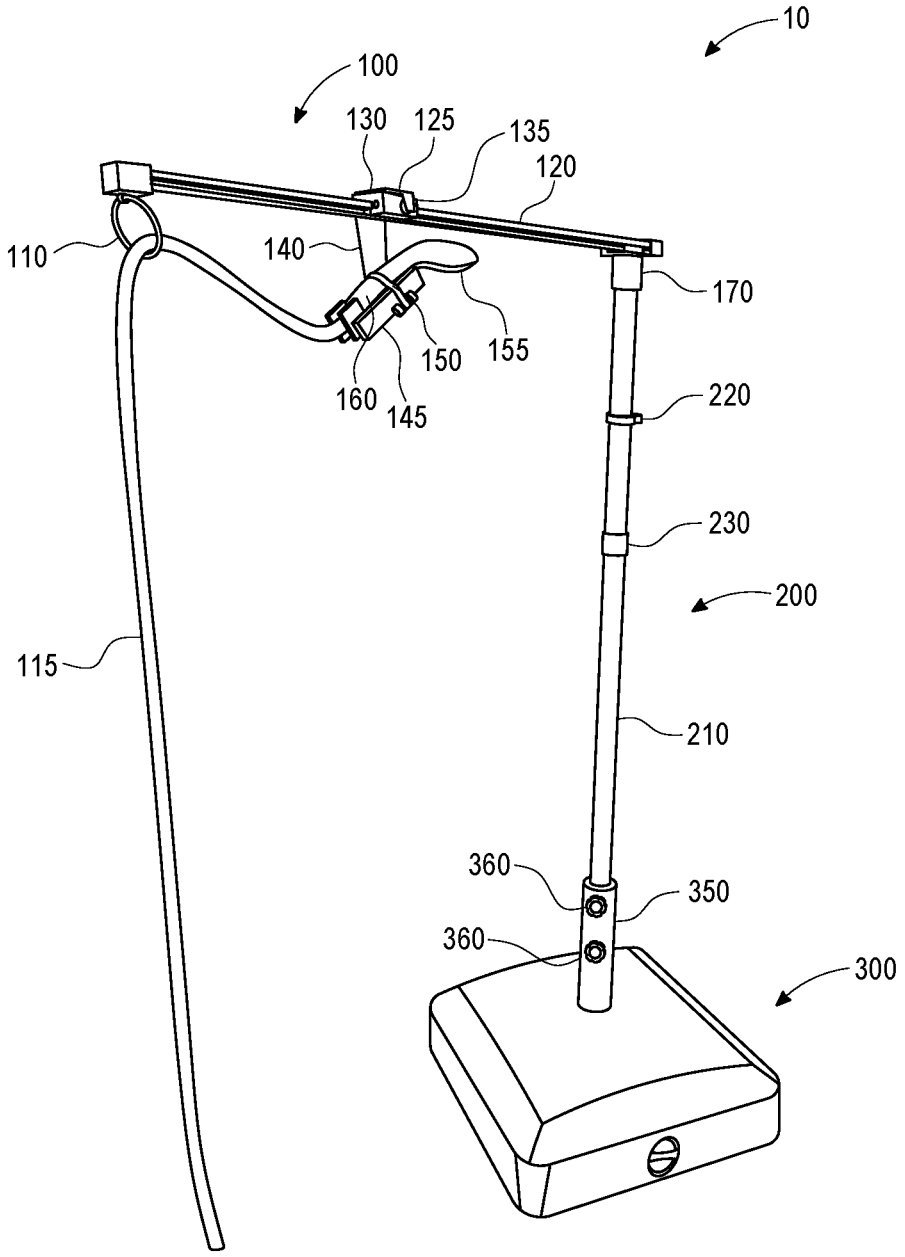
FIG. 1 depicts a perspective view of a showerhead support system.
Figure 3:
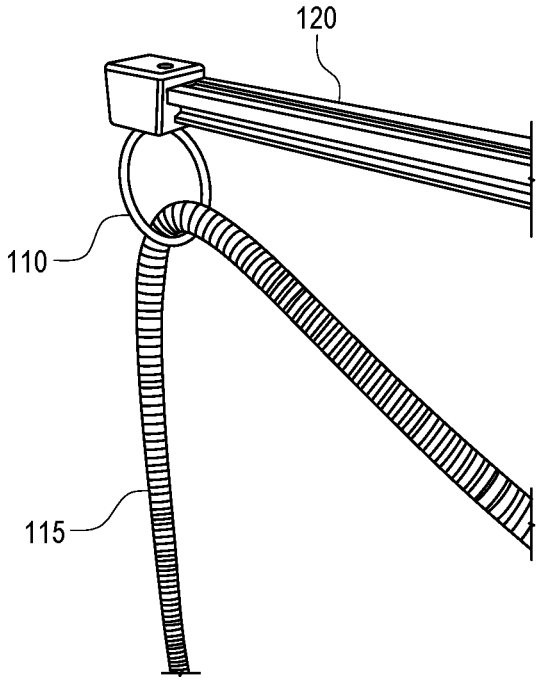
FIG. 3 depicts a perspective view of a showerhead hose support of a showerhead support system.

Showerhead support system 10 provides a user with three degrees of freedom for the showerhead 155, 1) front to back, 2) telescoping or height (that is, showerhead 155 can be moved up and down to adjust for different heights of the user), and 3) side to side or laterally. In this way, showerhead support system 10 can provide shower spray to most areas of the body. As shown in FIGS. 1 and 3, showerhead support assembly 100 includes a showerhead support track 120, which is positioned horizontally and includes showerhead hose support 110, which supports a showerhead hose 115. In one embodiment, showerhead hose support 110 is configured as an O-ring connected to the distal end of showerhead support track 120. Showerhead hose support 110 may be made of any suitable material, including, but not limited to metal, plastic, rubber or any combination thereof. It is understood that while showerhead hose support 110 is depicted as an O-ring, any suitable ring that is capable of supporting a showerhead hose may be substituted. Showerhead hose support 110 is capable of supporting showerhead hose 115 while allowing showerhead hose 115 to move easily through showerhead hose support 110. Showerhead hose support 110 also ensures that showerhead hose 115 doesn't hit the person using the showerhead support system 100. Although less preferred, showerhead support system 100 will function without showerhead hose support 110. Although not depicted, showerhead hose 115 is connected a water source.

Figure 2:
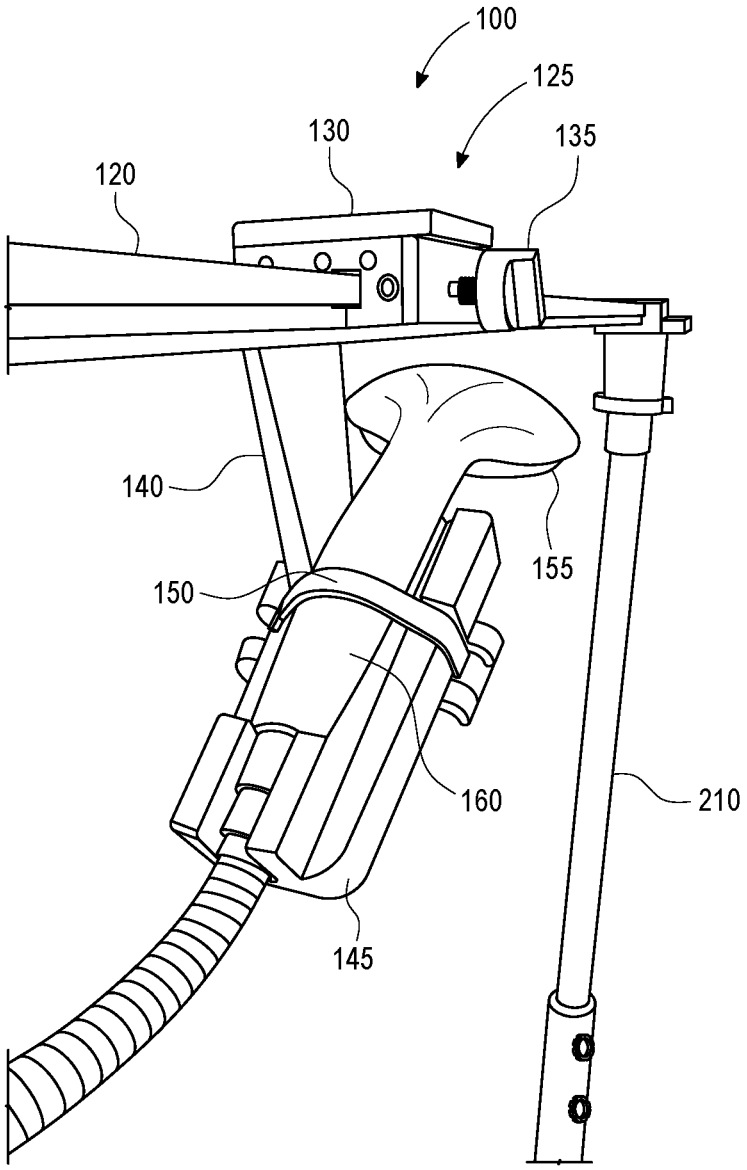
FIG. 2 depicts an exploded perspective view of a showerhead support assembly of a shower head support system.

FIG. 2 depicts an exploded view of the showerhead support assembly 100, including showerhead support connector assembly 125, which includes showerhead support track 120, connector 130, adjuster 135, extender 140, showerhead handle support 145, to support the showerhead handle 160, and fastener 150, to secure showerhead 155 in place.

Figure 4:
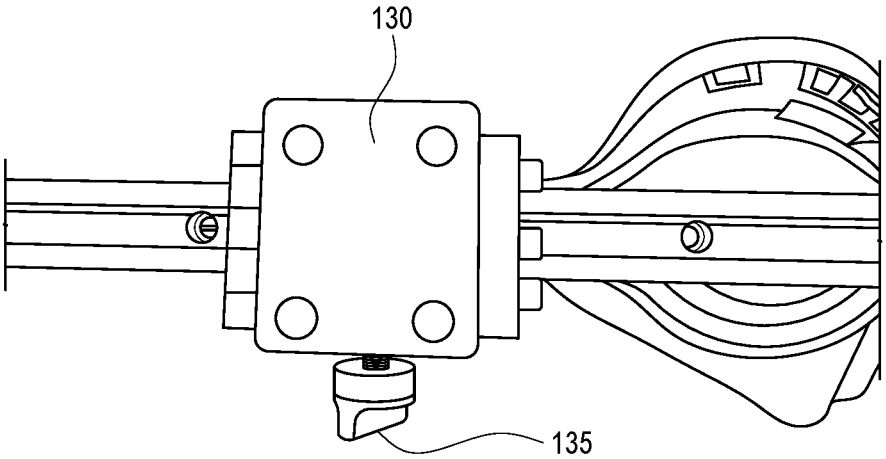
FIG. 4 depicts an overhead view of a showerhead support track and connector of a showerhead support system.

FIG. 4 depicts and overhead view of connector 130, which is configured to engage with showerhead support track 120 such that connector 130 is able to move laterally to any position along showerhead support track 120. Once the desired position is reached, adjuster 135 is capable of impinging on showerhead support track 120 so that connector 130 is held securely in place along showerhead support track 120. Extender 140 extends vertically from connector 130 and is connected to showerhead handle support 145, which is configured to support a showerhead handle 160. Preferably, showerhead handle support 145 is is positioned diagonally such that the showerhead 155 is higher than the bottom of showerhead handle 160. That is, a bottom end of showerhead handle support 145 supports the bottom of showerhead handle 160, while a top end of showerhead handle support 145 supports the top of showerhead handle 160. Fastener 150 holds showerhead 155 in place on showerhead handle support 145.

All of the components of showerhead support connector assembly may be made of any suitable material, including, but not limited to metal, plastic, rubber or any combination thereof.

Figure 5:
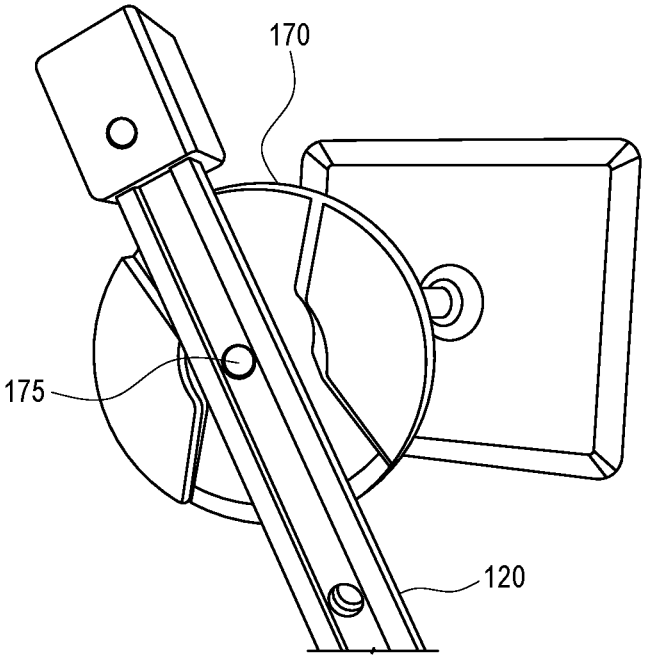
FIG. 5 depicts an overhead view of a showerhead support pivot of a showerhead support system.

FIG. 5 depicts showerhead support pivot 170, which is configured to receive showerhead support track 120 and includes a recess that allows showerhead support track 120 to pivot, thereby providing showerhead support assembly 100 the ability to move side to side or laterally. Showerhead support pivot 170 is also configured to receive the top of showerhead leg 210.

Figure 6:
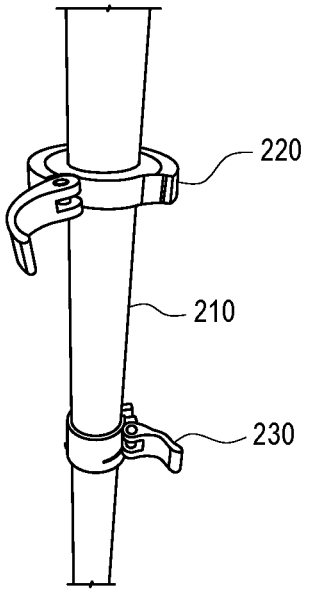
FIG. 6 depicts a perspective view of a showerhead support leg of a showerhead support system.
Figure 7:
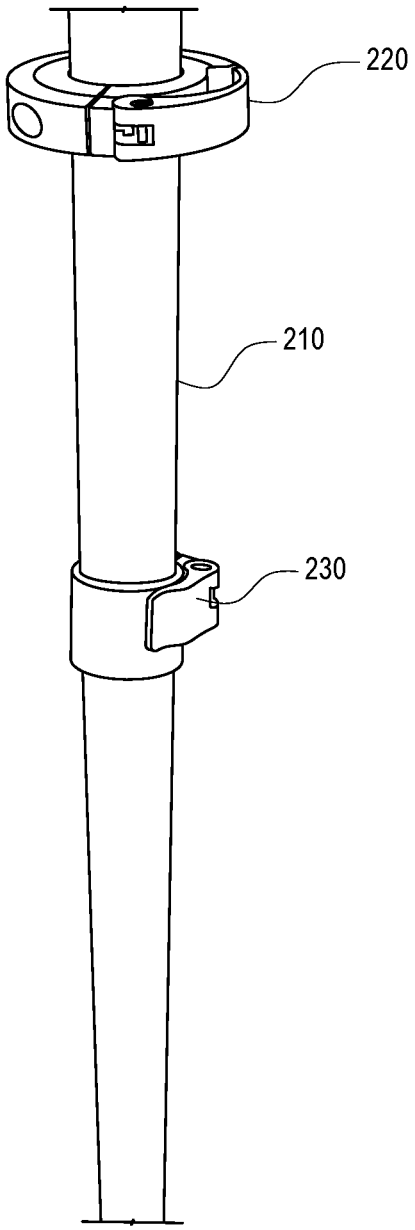
FIG. 7 a perspective view of a showerhead support leg of a showerhead support system.

Showerhead leg assembly 200 is depicted in FIGS. 1, 6, and 7, and includes showerhead support leg 210. In one embodiment, showerhead support leg 210 is embodied as a single piece capable of being received by showerhead support base 300 and capable of connecting to showerhead support track 120. Showerhead support leg 210 may be tubular in shape.

In one embodiment, showerhead support leg 210 may include two pieces that are capable of being adjusted in height by way of first height adjustment bracket 220 and second height adjustment bracket 230. Telescoping height adjustment is well known in the industry and thus will not be further described herein. First height adjustment bracket 220 and second height adjustment bracket 230 are capable of locking in place so that showerhead support leg 210 does not move. Second height adjustment bracket 230 prevents the height of showerhead support leg 210 from being adjusted below a certain point.

Figure 8:
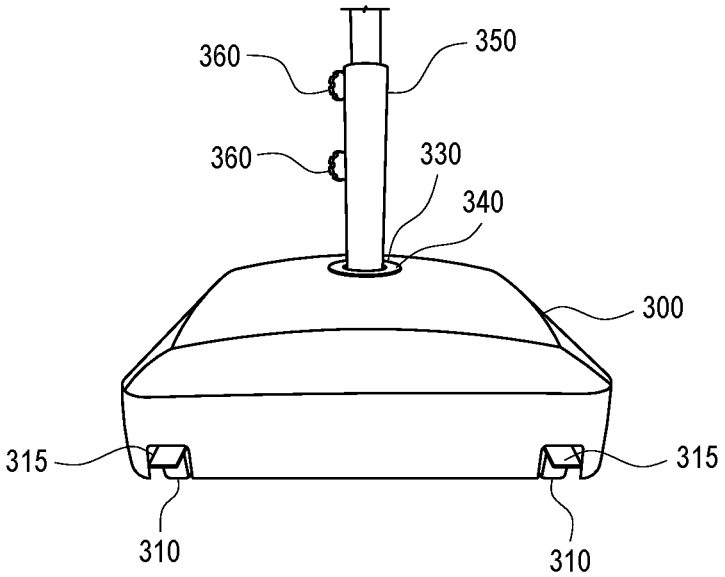
FIG. 8 depicts a back view of a showerhead support base of a showerhead support system.
Figure 9:
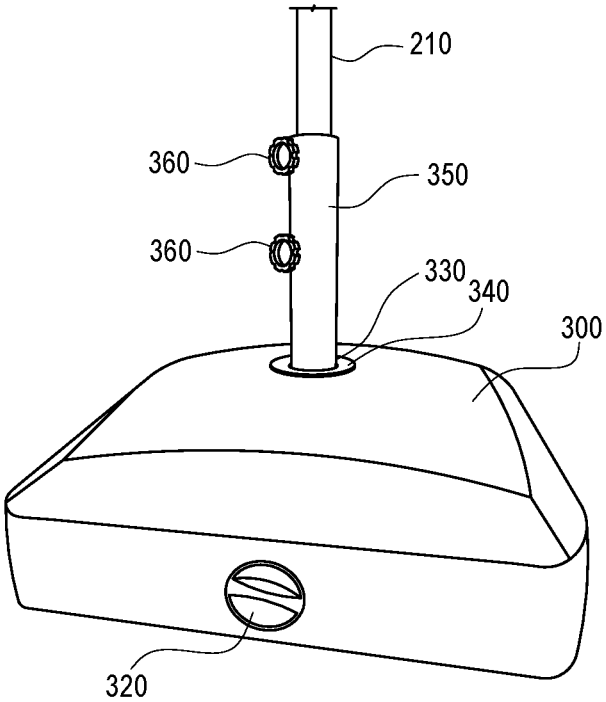
FIG. 9. depicts a side view of a showerhead support base of a showerhead support system.

Showerhead support base 300 is depicted in FIGS. 1, 8, and 9. In the views, showerhead support base 300 is depicted as having a square shape, but it is understood that showerhead support base 300 may have any suitable shape that provides enough support to showerhead support system 10. Showerhead support system 10 includes recess 330 and raised portion or washer 340. Recess 330 is configured to receive support guide 350.

Support guide 350 is embodied as a hollow tube, which is capable of receiving and guiding showerhead support leg 210. Support knobs 360 may be tightened so as to impinge on showerhead support leg 210 thereby providing a tight fit. In other embodiments, support guide 350 may be excluded, although this will reduce stability.

As seen in FIG. 8, showerhead support base 300 includes wheels 310, which have wheel locks 315. In a preferred embodiment, there are four wheels 310, but it is understood that any suitable number of wheels may be used. Wheel locks 315 allow the user to lock the showerhead support base 300 in place once it is at a desired location. Preferably, showerhead support base 300 includes two wheel locks 315. Although less preferred, showerhead support system 10 will function without wheel locks 315. Notably, showerhead support system 10 will also function without wheels 310.

As seen in FIG. 9, showerhead support base 300 optionally includes a knob 320, which can be opened to fill showerhead support base 300 with water or sand or any other suitable material so that it is heavier and more stable.

It is noted that any configuration of showerhead support base 300 may be suitable as long as it is capable of directly or indirectly supporting support leg 210. In a less preferred embodiment, showerhead support leg 210 may be affixed directly to showerhead support base 300.

Materials and Construction

In most embodiments, showerhead support system 10 will be constructed mainly out of plastic and metal, mostly aluminum. It is noted that any suitable material may be used to make the various components of showerhead support system 10. The connectors will be mostly constructed from molded plastics.

Key and Distinguishing Features

The features of showerhead support system 10 provide its users with independence, flexibility, comfort, containment, while saving time. In terms of independence and flexibility, showerhead support system 10 has multiple degrees of freedom (flexibility). Showerhead support system 10 puts less strain on the individual and allows them to stay in the warm water for the duration of the bathing process, which provides a more comfortable and pleasurable bathing experience. The combination of showerhead holster and hose guard ensure that the flow of water is controlled and thus contained. Showerhead support system 10 promotes independence while bathing making it more pleasurable and eliminating the need for assistance, which ultimately saves time.

ALTERNATIVE EMBODIMENTS

Although showerhead support system 10 is primarily described as a standalone system, it is understood that showerhead support system assembly 100 may function without showerhead support leg assembly 300 or showerhead support base 300. In this embodiment, showerhead support system assembly 100 may be attached directly to the wall of the shower or may be suspended from the ceiling of the shower. In these embodiments, showerhead support track 120 may or may not be capable of pivoting. In the embodiment where showerhead support system assembly 100 is connected to the wall of the shower, the connection point may be capable of providing a pivoting motion for the showerhead support track 120. In the embodiment where showerhead support system 100 assembly is suspended overhead, it may be more difficult to provide a pivoting motion for the showerhead support track 120.

It will be appreciated by those skilled in the art that while the standalone showerhead support system 10 has been described in detail herein, the invention is not necessarily so limited and other examples, embodiments, uses, modifications, and departures from the embodiments, examples, uses, and modifications may be made without departing from the process and all such embodiments are intended to be within the scope and spirit of the appended claims.

What is claimed is:

1. A standalone showerhead support system comprising:

a showerhead support assembly having a showered hose support, a showerhead support track, a showerhead support connector assembly capable of sliding laterally along the showerhead support track, a showerhead support leg, and a showerhead support base;

wherein the showerhead hose support is capable of supporting a showerhead hose and is connected to a first end of the showerhead support track;

wherein the showerhead support track includes a showerhead pivot assembly at a second end;

wherein the showerhead pivot assembly has a recess capable of allowing the showerhead support track to pivot rotatably and is connected to the top of showerhead support leg;

wherein the showerhead support connector assembly includes a connector capable of engaging with and sliding along the showerhead support track, an extender extending from the connector, and a showerhead handle support attached to the extender and capable of supporting a showerhead handle; and, wherein the showerhead support base has a recess capable of receiving showerhead support leg.

2. The standalone shower support system of claim 1 wherein the showerhead hose support is an O-ring.

3. The standalone showerhead support system of claim 1, wherein the showerhead support track is arranged horizontally and the showerhead support leg is arranged vertically.

4. The standalone showerhead support system of claim 1 wherein the showerhead support connector assembly is configured as one piece.

5. The standalone showerhead support system of claim 1 wherein the showerhead handle support of the showerhead support connector assembly also includes a fastener capable of securing a showerhead in place.

6. The standalone showerhead support system of claim 4 wherein the showerhead handle support of the showerhead support connector assembly also includes a fastener capable of securing a showerhead in place.

7. The standalone showerhead support system of claim 1, wherein the showerhead support base has wheels, which are optionally capable of locking.

8. The standalone showerhead support system of claim 1, wherein the showerhead support leg is height adjustable.

9. A standalone showerhead support system comprising:

a showerhead support track, a showerhead support connector assembly capable of sliding laterally along the showerhead support track, a showerhead support leg, and a showerhead support base;

wherein the showerhead support connector assembly includes a connector capable of engaging with and sliding along the showerhead support track, an extender extending from the connector, and a showerhead handle support attached to the extender and capable of supporting a showerhead handle; and, wherein the showerhead support base has a recess capable of receiving the showerhead support leg.

10. The standalone showerhead support system of claim 9 wherein the showerhead support assembly further includes a showered hose support capable of supporting a showerhead hose and connected to a first end of showerhead support track.

11. The standalone showerhead support system of claim 10 wherein the showerhead support track further includes a showerhead pivot assembly at a second end wherein the showerhead pivot assembly has a recess capable of allowing the showerhead support track to pivot rotatably and is connected to the top of the showerhead support leg.

12. A showerhead support system comprising:

a showerhead support track and a showerhead support connector assembly capable of sliding laterally along the showerhead support track; and wherein the showerhead support connector assembly includes a connector capable of engaging with and sliding along the showerhead support track, an extender extending from the connector, and a showerhead handle support attached to the extender and capable of supporting a showerhead handle.

13. The showerhead support system of claim 12 wherein the showerhead support assembly further includes a showered hose support capable of supporting a showerhead hose and connected to a first end of showerhead support track.

14. The showerhead support system of claim 13 wherein the showerhead hose support is an O-ring.

15. The showerhead support system of claim 13 wherein the showerhead handle support of the showerhead support connector assembly also includes a fastener capable of securing a showerhead in place.

* * * * *